US009981161B2

(12) United States Patent
Abbott

(10) Patent No.: US 9,981,161 B2
(45) **Date of Patent: *May 29, 2018**

(54) GOLF CLUB FACE INSERT

(71) Applicant: Callaway Golf Company, Carlsbad, CA (US)

(72) Inventor: Craig E. Abbott, Klamath Falls, OR (US)

(73) Assignee: Callaway Golf Company, Carlsbad, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/706,761

(22) Filed: Sep. 18, 2017

(65) Prior Publication Data

US 2018/0001156 A1 Jan. 4, 2018

Related U.S. Application Data

(63) Continuation of application No. 15/189,774, filed on Jun. 22, 2016, now Pat. No. 9,776,051.

(60) Provisional application No. 62/247,589, filed on Oct. 28, 2015.

(51) Int. Cl.
*A63B 53/04* (2015.01)
*A63B 53/00* (2015.01)

(52) U.S. Cl.
CPC ..... *A63B 53/04* (2013.01); *A63B 53/007* (2013.01); *A63B 53/0487* (2013.01); *A63B 2053/0416* (2013.01)

(58) Field of Classification Search
CPC ... A63B 53/04; A63B 53/0487; A63B 53/007; A63B 2053/0416
USPC ..... 473/324–350, 287–292, 313–314
See application file for complete search history.

(56) References Cited

U.S. PATENT DOCUMENTS 6,193,615 B1 * 2/2001 Hirota ..... A63B 53/04 473/329
7,278,928 B2 * 10/2007 Newman ..... A63B 53/047 473/342
7,824,278 B2 * 11/2010 Miyamichi ..... A63B 53/0487 473/329
8,109,841 B2 * 2/2012 Miyamichi ..... A63B 53/0487 473/340
8,371,958 B2 * 2/2013 Treadwell ..... A63B 53/047 473/331
D800,857 S * 10/2017 Abbott ..... D21/759
9,776,051 B1 * 10/2017 Abbott ..... A63B 53/04

* cited by examiner

*Primary Examiner* — Sebastiano Passaniti
(74) *Attorney, Agent, or Firm* — Rebecca Hanovice; Michael Catania; Sonia Lari

(57) ABSTRACT

A resilient face insert for a golf club head, preferably a putter head, is disclosed herein. In particular, the face insert comprises a plurality of hinge features spaced from a striking surface to ensure consistent ball speed across the striking surface. At least a portion of each hinge feature extends parallel to the striking surface without making contact with the striking surface. In the preferred embodiment, each hinge feature comprises a tab portion that is spaced from the striking surface by a stem portion and that extends parallel to the striking surface. The hinge features may be co-molded with a polymeric backing material in order to further improve performance of the face insert.

20 Claims, 7 Drawing Sheets

GOLF CLUB FACE INSERT

CROSS REFERENCES TO RELATED APPLICATIONS

The present application is a continuation of U.S. patent application Ser. No. 15/189,774, filed on Jun. 22, 2016, and issued on Oct. 3, 2017, as U.S. Pat. No. 9,776,051, which claims priority to U.S. Provisional Patent Application No. 62/247,589, filed on Oct. 28, 2015, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club face insert comprising a plurality of miniature hinges extending from and disposed across a striking surface.

Description of the Related Art

The prior art discloses many different types of face inserts for golf club heads, including putters, that are intended to improve face performance. For example, U.S. Pat. No. 7,278,928 discloses a striking face with a plurality of solid geometric protrusions, U.S. Pat. No. 7,824,278 discloses a putter face with a plurality of pillar-shaped bodies made of a material having a higher rigidity than a golf ball, U.S. Pat. No. 8,109,841 discloses a face with a plurality of microscopic protrusions having a stiffness higher than that of a golf ball, and U.S. Pat. No. 8,371,958 discloses a golf club face with a plurality of pyramidal shaped extensions protruding therefrom. There is, however, still a need for a putter face that optimizes performance and increases the consistency of ball speed across the face.

BRIEF SUMMARY OF THE INVENTION

One aspect of the present invention is a golf club face insert comprising a striking surface and a plurality of hinge features connected to and extending away from the striking surface, wherein at least a part of each of the plurality of hinge features extends parallel to the striking surface without making contact with the striking surface. In some embodiments, at least one of the plurality of hinge features may comprise an upper portion and a plurality of leg portions, each of the plurality of leg portions may be connected to and extend away from the striking surface, and the upper portion may be spaced from the striking surface by the plurality of leg portions. In a further embodiment, the plurality of leg portions may comprise four leg portions. In alternative embodiments, at least one, if not all, of the plurality of hinge features may comprise a stem portion and a tab portion, the stem portion may be connected to and extend away from the striking surface, the tab portion may be connected to the stem portion, and the tab portion may extend parallel to the striking surface without making contact with the striking surface. In a further embodiment, the plurality of hinge features may comprise at least twenty five hinge features.

In any of these embodiments, each of the plurality of hinge features may be evenly spaced from each adjacent hinge feature along a horizontal axis. In a further embodiment, the plurality of hinge features may comprise at least one row of hinge features extending horizontally across the striking surface. In another embodiment, the at least one row of hinge features may comprise a first row, a second row, and a third row, and each row may be evenly spaced from adjacent rows of hinge features along a vertical axis.

Another aspect of the present invention is a golf club face insert comprising a striking plate comprising a base portion, a plurality of hinge features, a plurality of through-holes, and a first thickness, and a backing portion comprising a second thickness that is greater than the first thickness, wherein the striking portion is composed of a first material, wherein the backing portion is composed of a second material that is different from the first material, and wherein each of the plurality of hinge features comprises a stem portion that extends perpendicular to the base portion and a tab portion that is spaced from the base portion by the stem portion and extends parallel to the base portion without making contact with the base portion. In a further embodiment, the backing portion may be composed of a polymeric material and be co-molded with the striking plate. In another embodiment, the striking plate may be composed of a metal material such as stainless steel or titanium alloy and the backing portion may be composed of a polymeric material such as urethane.

In yet another embodiment, each tab portion may be spaced from the base portion by a distance of 0.010 to 0.030 inch, may have a width of 0.025 to 0.075 inch, and may have a length of 0.050 to 0.080 inch. In another embodiment, each hinge feature may be spaced horizontally from each adjacent hinge feature by a distance of 0.020 to 0.060 inch, and each hinge feature may be spaced vertically from each adjacent hinge feature by a distance of 0.020 to 0.050 inch. In yet another embodiment, each of the plurality of through-holes may be at least partially disposed beneath a tab portion of the plurality of hinge features.

Yet another aspect of the present invention is a putter head comprising a body comprising a top surface, a bottom surface, a heel side, a toe side, and a front surface comprising a recess, and a face insert sized to fit within the recess, wherein the face insert comprises a polymeric backing portion co-molded with a metal striking plate, wherein the metal striking plate comprises a planar base portion, a plurality of hinge features, and a plurality of through-holes, wherein each of the plurality of hinge features comprises a stem portion that extends perpendicular to the planar base portion and a tab portion that is spaced from the planar base portion by the stem portion and extends parallel to the planar base portion without making contact with the planar base portion, and wherein each of the plurality of through-holes is at least partially disposed beneath a tab portion of the plurality of hinge features. In some embodiments, each tab portion may be spaced from the base portion by a distance of 0.010 to 0.030 inch. In other embodiments, each tab portion may have a width of 0.025 to 0.075 inch and a length of 0.050 to 0.080 inch. In yet other embodiments, the face insert may have a thickness of 0.100 to 0.300 inch. In another embodiment, each hinge feature may be spaced horizontally from each adjacent hinge feature by a distance of 0.020 to 0.060 inch and spaced vertically from each adjacent hinge feature by a distance of 0.020 to 0.050 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
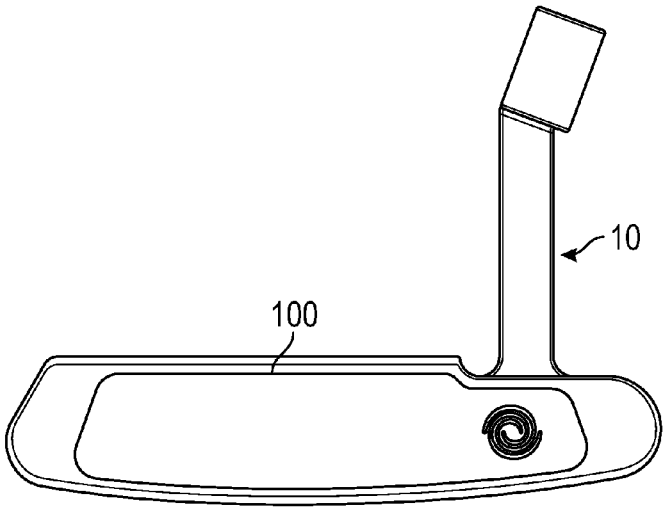
FIG. 1 is a front plan view of a putter head sized to receive any of the face inserts of the present invention.
Figure 2:
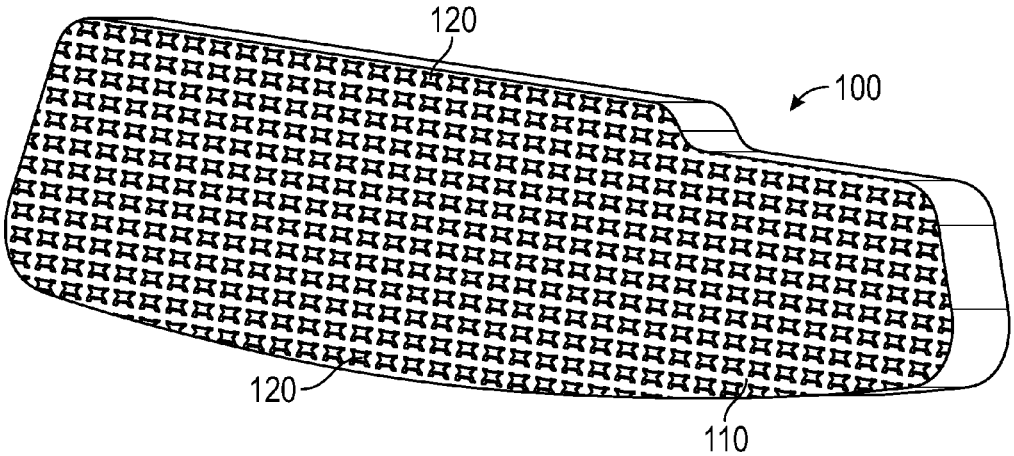
FIG. 2 is a front elevational view of a first embodiment of the face insert of the present invention.
Figure 3:
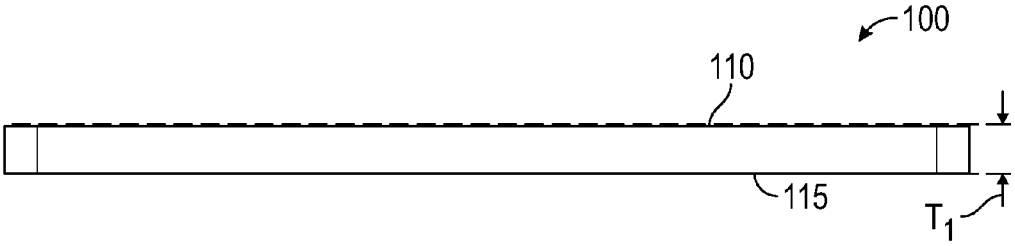
FIG. 3 is a bottom plan view of the embodiment shown in FIG. 2.
Figure 4:
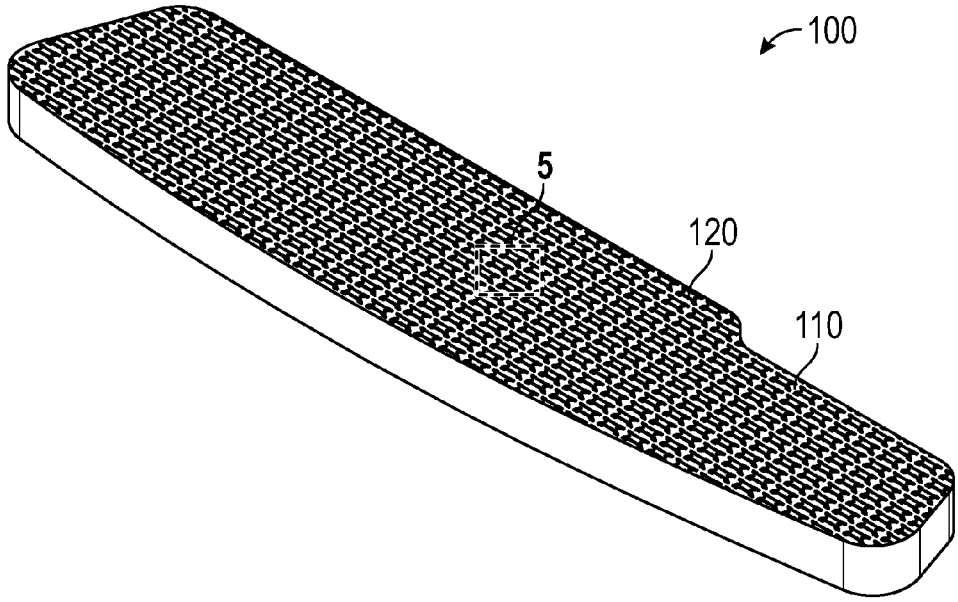
FIG. 4 is a front perspective view of the embodiment shown in FIG. 2.
Figure 5:
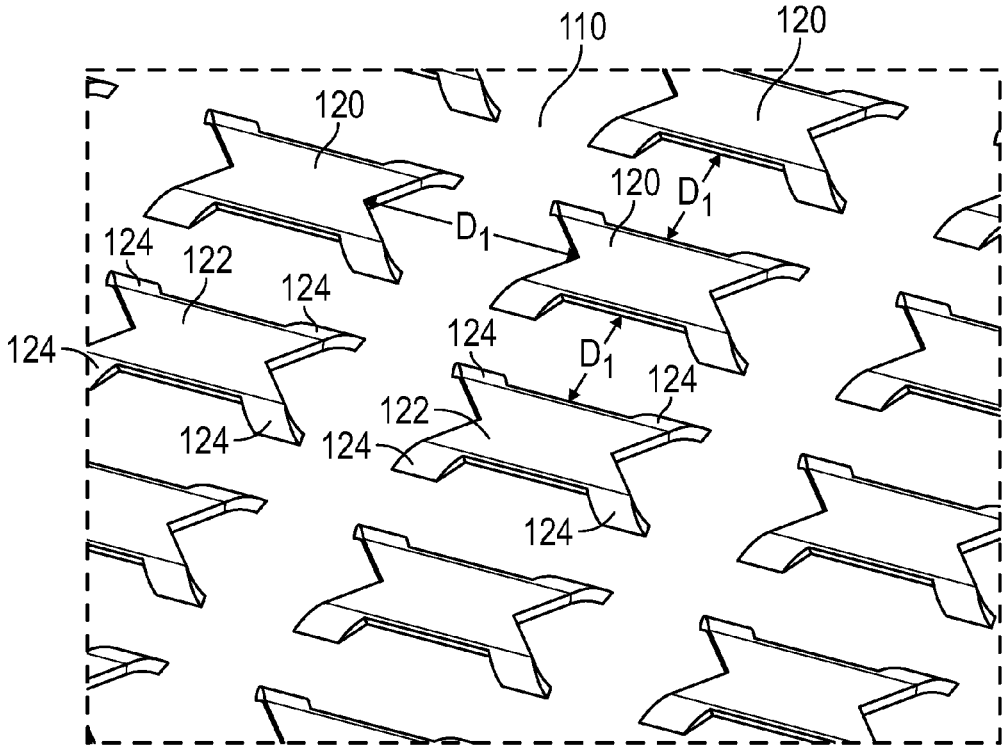
FIG. 5 is a magnified view of the circled portion of the embodiment shown in FIG. 4.
Figure 6:
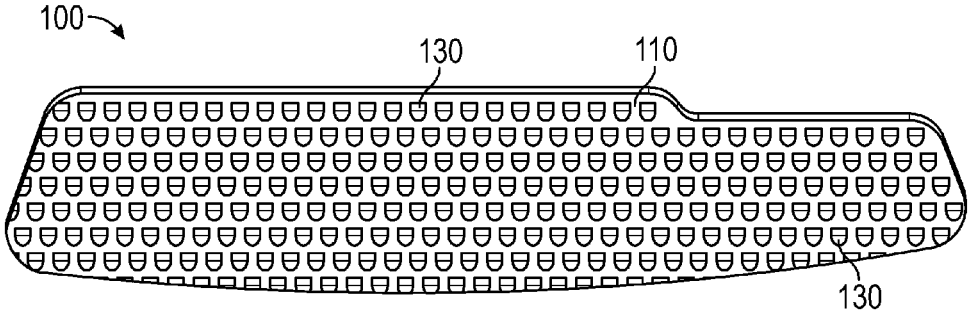
FIG. 6 is a front elevational view of a second embodiment of the face insert of the present invention.
Figure 7:
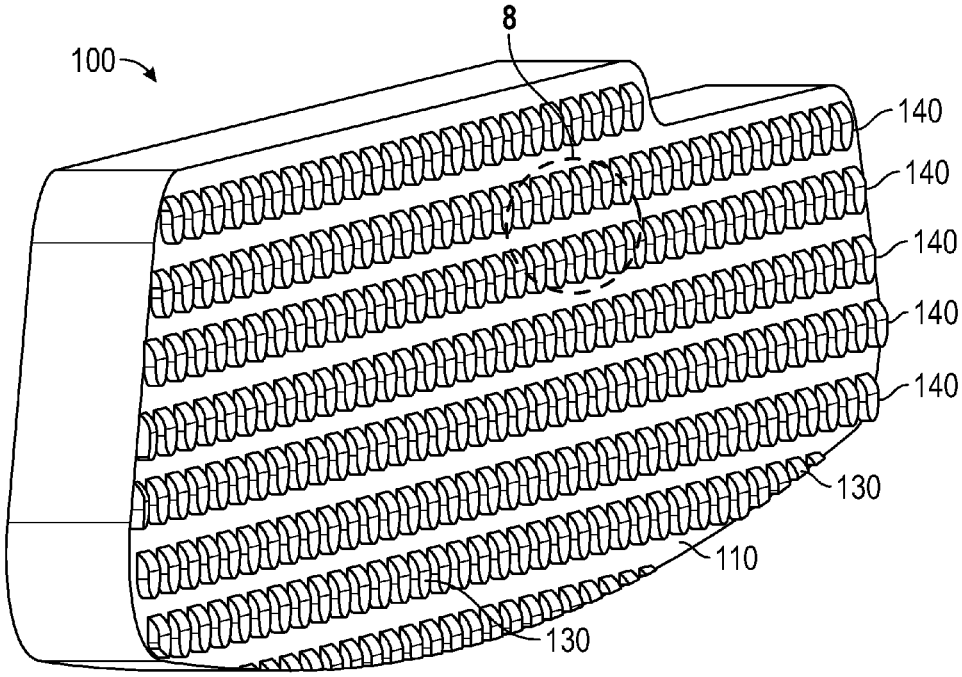
FIG. 7 is a side perspective view of the embodiment shown in FIG. 6.
Figure 8:
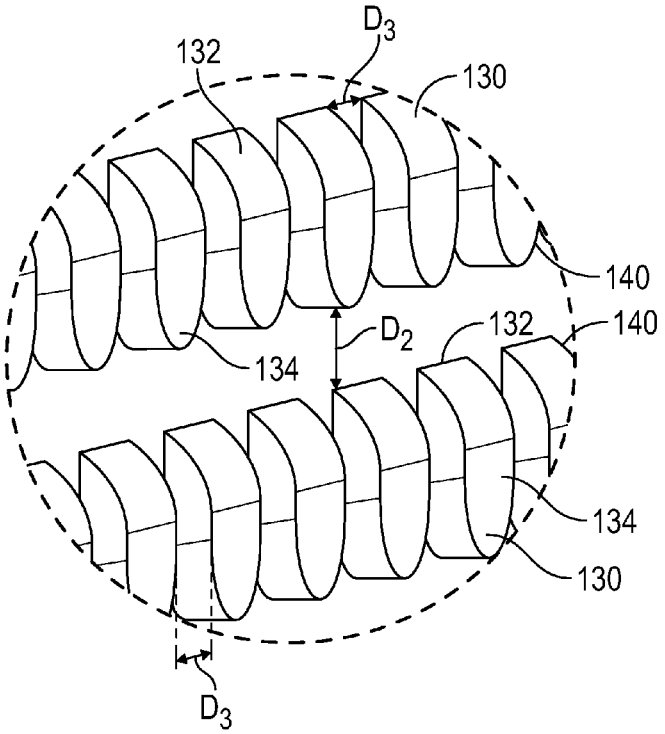
FIG. 8 is a magnified view of the circled portion of the embodiment shown in FIG. 7.
Figure 9:
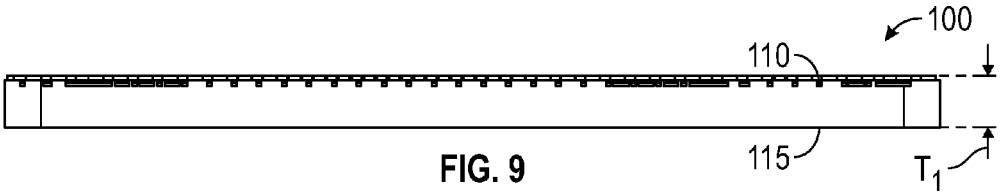
FIG. 9 is a bottom plan view of the embodiment shown in FIG. 6.
Figure 10:
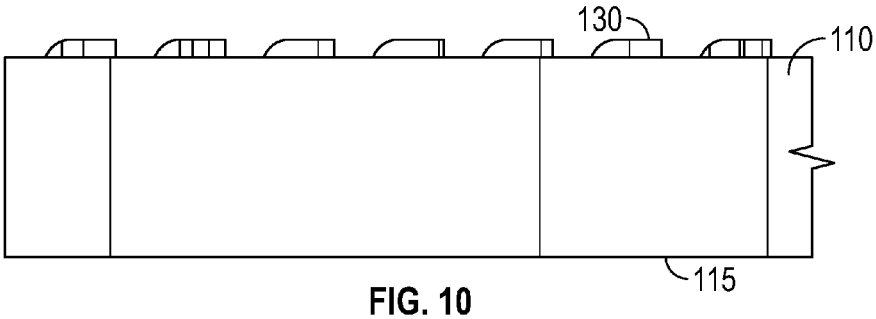
FIG. 10 is a magnified, side elevational view of the embodiment shown in FIG. 6.
Figure 11:
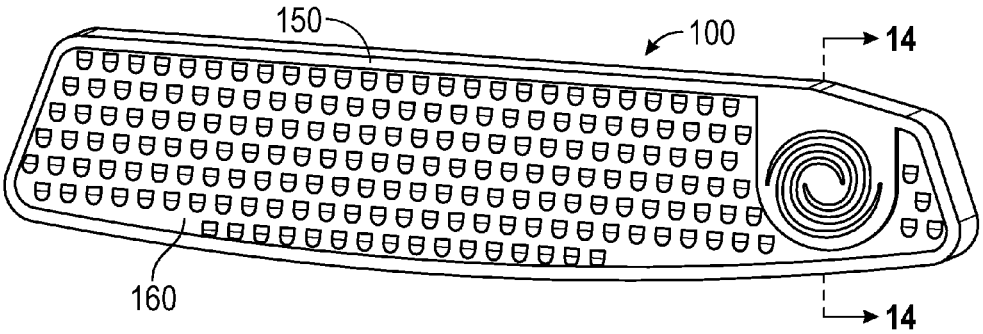
FIG. 11 is a front elevational view of a third embodiment of the face insert of the present invention.
Figure 12:
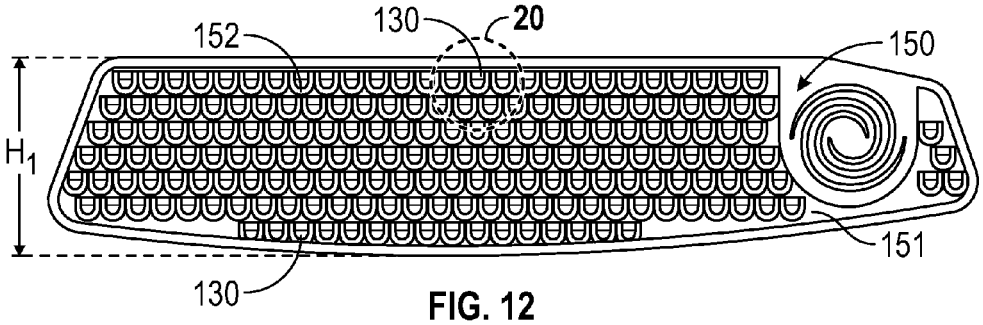
FIG. 12 is a front elevational view of the sheet of metal mesh shown in FIG. 11.
Figure 13:
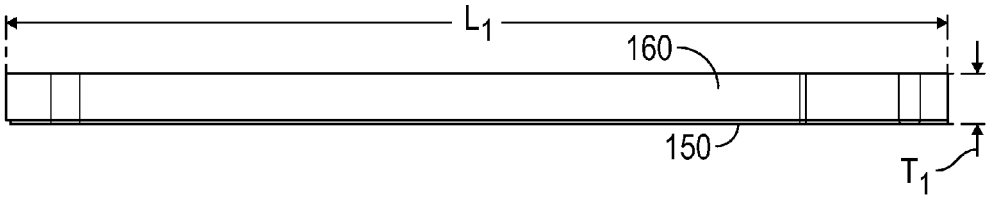
FIG. 13 is a top plan view of the embodiment shown in FIG. 11.
Figure 14:
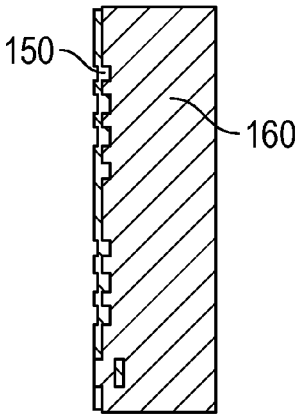
FIG. 14 is a cross-sectional view of the embodiment shown in FIG. 11 along lines 14-14.

Each embodiment of the present invention is directed to a face insert 100 for a golf club head, preferably a putter head 10, which provides consistent ball speed across the striking surface. An exemplary putter head 10 that would benefit from any of the embodiments of the face insert 100 of the present invention is shown in FIG. 1.

In a first embodiment, shown in FIGS. 2-5, the face insert 100 comprises a striking surface 110, a rear surface 115, a thickness $T_1$, and a plurality of trampoline-shaped hinge features 120 disposed across the striking surface 110. In this embodiment, each hinge feature 120 comprises an hour-glass-shaped upper portion 122 that is spaced from the striking surface 110 by a plurality of support legs 124 that are connected to, and extend away from, the striking surface 110. In an alternative embodiment, the upper portion 122 of one or more of the trampoline-shaped hinge features 120 may be at least partially affixed to the striking surface 110. Each of the hinge features 120 is spaced an equal distance $D_1$ from adjacent hinge features 120. When contacted by a golf ball, the upper portion 122 flexes inwards towards the striking surface 110, and provides the face insert 100 with greater elasticity.

A second embodiment is shown in FIGS. 6-10. In this embodiment, the face insert 100 includes all of the same features as the first embodiment, except that the hinge features 130 comprise downward facing tabs aligned in a plurality of horizontal rows 140 across the striking surface 110. Each tabbed hinge feature 130 comprises a stem portion 132 that is connected to, and extends perpendicularly away from, the striking surface 110, and a tab portion 134 that is spaced from the striking surface 110 and extends downwardly away from the stem portion 132 and parallel with the striking surface 110. In this embodiment, each horizontal row 140 is spaced from adjacent horizontal rows 140 by an equal distance $D_2$, and each hinge feature 130 is spaced horizontally from adjacent hinge features by an equal distance $D_3$ that is smaller than distance $D_2$. When contacted by a golf ball, the tab portions 134 are compressed inwards towards the striking surface 110, and provide the face insert 100 with greater elasticity. In an alternative embodiment, one or more of the tab portions 134 may be at least partially affixed to the striking surface 110.

In the preferred embodiment, shown in FIGS. 11-20, the face insert 100 is composed of two pieces: a thin sheet of metal mesh 150 comprising a planar base portion 151 with a plurality of tabbed hinge features 130 and a plurality of at least partially exposed through-holes 152, which may be stamped, chemical etched, machined, and/or otherwise added to the metal mesh 150 by any means known to a person skilled in the art; and a polymeric backing portion 160 that preferably is co-molded onto the metal mesh 150 but in alternative embodiments may be permanently attached to the metal mesh 150 with an adhesive. The metal used to make the metal mesh 150 preferably is stainless steel or titanium alloy, while the polymeric backing portion 160 preferably is composed of a urethane material.

Figure 15:
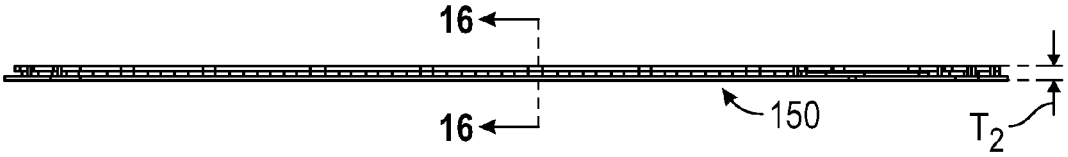
FIG. 15 is a top plan view of the sheet of metal mesh shown in FIG. 12.
Figure 16:
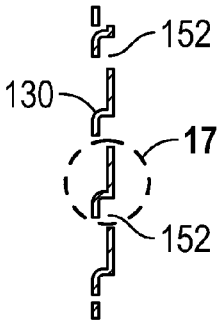
FIG. 16 is a cross-sectional view of the sheet of metal mesh shown in FIG. 15 along lines 16-16.
Figure 17:
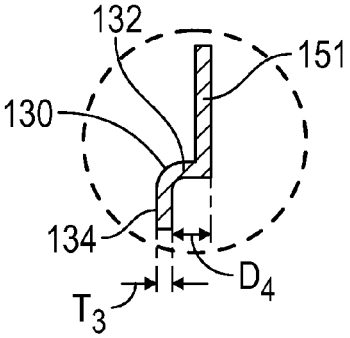
FIG. 17 is an enlarged view of the circled portion of the embodiment shown in FIG. 16.
Figure 18:
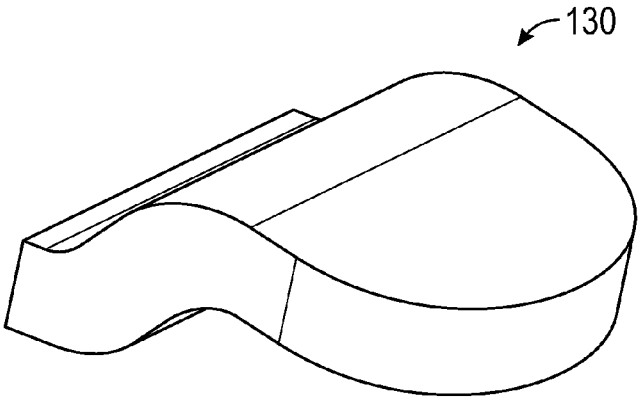
FIG. 18 is a side perspective view of one of the hinge features shown in FIG. 12.
Figure 19:
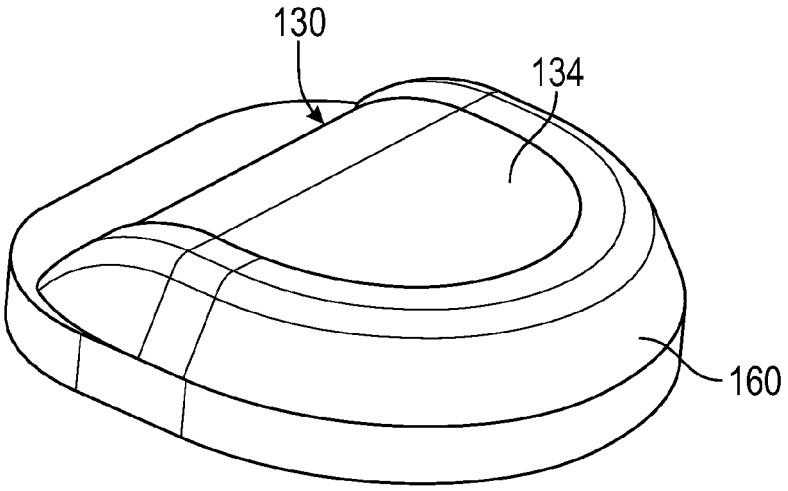
FIG. 19 is a side perspective view of the hinge feature shown in FIG. 18 co-molded with a polymeric material.
Figure 20:
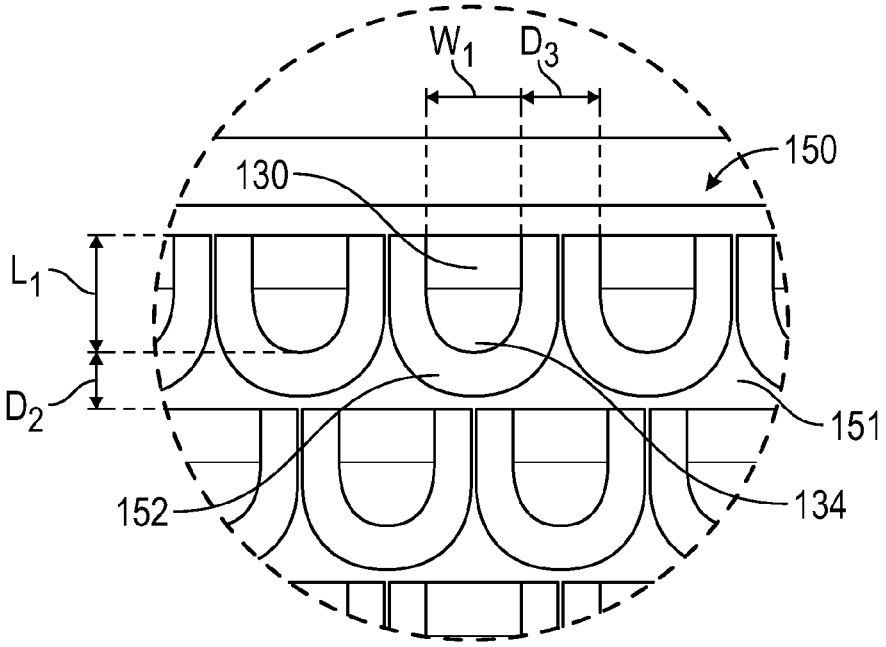
FIG. 20 is an enlarged view of the circled portion of the sheet of metal mesh shown in FIG. 12.

As shown in FIG. 15, the metal mesh 150 preferably has a maximum thickness $T_2$ of 0.025-0.075 inch, and more preferably 0.051 inch. As shown in FIGS. 16 and 17, each tabbed hinge feature 130 preferably has a thickness $T_3$ of 0.010 to 0.020 inch, more preferably 0.016 inch, and the tab portion 134 of the hinge feature 130 is spaced a distance $D_4$ of 0.010 to 0.030 inch, and more preferably 0.019 inch, from the planar base portion 151. As shown in FIG. 20, each of the tabbed hinge features 130 has a width $W_1$ of 0.025 to 0.075 inch, and more preferably approximately 0.052 inch, a length $L_1$ of 0.050 to 0.080 inch, and more preferably approximately 0.066 inch, and is spaced horizontally from neighboring hinge features 130 by a distance $D_3$ of 0.020 to 0.060 inch, and more preferably approximately 0.048 inch, and vertically by a distance $D_2$ of 0.020 to 0.050 inch, and more preferably approximately 0.034 inch. An exemplary hinge feature 130 from the metal mesh 150 is shown in FIG. 18, and the same hinge feature 130 co-molded with the polymeric backing portion 160 is shown in FIG. 19, illustrating how the polymer fills the spaces underneath the tab portions 134 in the metal mesh 150.

Each of the embodiments disclosed herein preferably has at least 25 hinge features 120, 130 on the striking surface 110. Each of the face insert embodiments disclosed herein may have a length $L_1$ of 3 to 4 inches, more preferably approximately 3.7 inches, a height $H_1$ of 0.500 to 1 inch, more preferably approximately 0.785 inch, and an overall thickness $T_1$ of 0.100 to 0.300 inch, and more preferably approximately 0.200 inch.

As shown in the embodiments herein, the hinge features 120, 130 preferably are evenly spaced, vertically and horizontally, across the striking surface 110, but in alternative embodiments, the vertical and/or horizontal spacing between the hinge features 120, 130 may vary across the striking surface 110, such that more hinge features 120, 130 are located in regions on the striking surface 110 where greater resilience is required for improved ball speed.

Each of the face insert 100 embodiments disclosed herein preferably comprises a polymer material, such as urethane, and the hinge features 120, 130 may be integrally formed with the rest of the face insert 100 or may be co-molded onto the face insert 100 from a different material with a different resiliency. In one embodiment, the face insert 100 may be molded from a hard plastic and the hinge features 120, 130 may be co-molded with the rest of the face insert 100 from a softer plastic. In another, the face insert 100 may be made from a metal material and the hinge features 120, 130 may be co-molded over the face insert 100 from an elastic polymer material.

Though each of the face insert 100 embodiments disclosed herein are shown in connection with a putter head 10, these embodiments may be used with any other golf club head, including drivers, fairway woods, irons, wedges, and hybrids.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club face insert comprising:

a striking plate comprising a base portion, a plurality of hinge features, a plurality of at least partially exposed through-holes, and a first thickness, wherein each of the plurality of hinge features comprises a stem portion that extends approximately perpendicular to the base portion and a tab portion that is spaced from the base portion by the stem portion and extends approximately parallel to the base portion without making contact with the base portion, and wherein each of the plurality of through-holes is at least partially disposed beneath one of the tab portions of the plurality of hinge features.

2. The golf club face insert of claim 1, further comprising a backing portion affixed to the striking plate.

3. The golf club face insert of claim 2, wherein the striking plate is composed of a first material, and wherein the backing portion is composed of a second material that is different from the first material.

4. The golf club face insert of claim 2, wherein the striking plate comprises a first thickness, and wherein the backing portion comprises a second thickness that is greater than the first thickness.

5. The golf club face insert of claim 2, wherein the backing portion is composed of a polymeric material and is co-molded with the striking plate.

6. The golf club face insert of claim 5, wherein the polymeric material is urethane.

7. The golf club face insert of claim 2, wherein the face insert comprises a length of 3 to 4 inches, a height of 0.500 to 1 inch, and a thickness of 0.100 to 0.300 inch.

8. The golf club face insert of claim 7, wherein the length is approximately 3.7 inches, wherein the height is approximately 0.785 inch, and wherein the thickness is approximately 0.200 inch.

9. The golf club face insert of claim 1, wherein the striking plate is composed of a metal material.

10. The golf club face insert of claim 9, wherein the metal material is selected from the group consisting of stainless steel and titanium alloy.

11. The golf club face insert of claim 1, wherein each of the tab portions is spaced from the base portion by a distance of 0.010 to 0.030 inch, wherein each of the tab portions has a width of 0.025 to 0.075 inch, and wherein each of the tab portions has a length of 0.050 to 0.080 inch.

12. The golf club face insert of claim 1, wherein each of the hinge features is spaced from each of the adjacent hinge features provided along a horizontal axis extending in a heel-to-toe direction by a distance of 0.020 to 0.060 inch, and wherein each of the hinge features is spaced from each of the adjacent hinge features provided along a vertical axis extending perpendicular to the horizontal axis in a top-to bottom direction by a distance of 0.020 to 0.050 inch.

13. The golf club face insert of claim 12, wherein the hinge features are evenly spaced from one another across the striking surface along both the horizontal and vertical axes.

14. A putter head comprising:

a body comprising a top surface, a bottom surface, a heel side, a toe side, and a front surface comprising a recess; and a face insert sized to fit within the recess, wherein the face insert comprises a metal striking plate comprising a planar base portion, a plurality of hinge features, and a plurality of at least partially exposed through-holes, wherein each of the plurality of hinge features comprises a stem portion that extends approximately perpendicular to the planar base portion and a tab portion that is spaced from the planar base portion by the stem portion and extends approximately parallel to the planar base portion without making contact with the planar base portion, wherein each of the plurality of through-holes is at least partially disposed beneath one of the tab portions of the plurality of hinge features, wherein each of the tab portions is spaced from the base portion by a distance of 0.010 to 0.030 inch, and wherein the striking plate has a maximum thickness of 0.025 to 0.075 inch.

15. The putter head of claim 14, wherein each of the tab portions has a width of 0.025 to 0.075 inch and a length of 0.050 to 0.080 inch.

16. The putter head of claim 14, wherein the face insert further comprises a backing portion affixed to the striking plate.

17. The putter head of claim 16, wherein the face insert has a thickness of 0.100 to 0.300 inch.

18. The putter head of claim 14, wherein each of the hinge features is spaced from each of the adjacent hinge features provided along a horizontal axis extending in a heel-to-toe direction by a distance of 0.020 to 0.060 inch, and wherein each of the hinge features is spaced from each of the adjacent hinge features provided along a vertical axis extending perpendicular to the horizontal axis in a top-to-bottom direction by a distance of 0.020 to 0.050 inch.

19. The putter head of claim 14, wherein the striking plate is composed of a metal material selected from the group consisting of stainless steel and titanium alloy.

20. The putter head of claim 14, wherein each of the hinge features has a thickness of 0.010 to 0.020 inch.

* * * * *